United States Patent [19]

Hinoda

[11] Patent Number: 4,808,280

[45] Date of Patent: Feb. 28, 1989

[54] METHOD FOR ELECTROLYTIC COLORING OF ALUMINIM OR ALUMINUM ALLOYS

[75] Inventor: Yuji Hinoda, Kawasaki, Japan

[73] Assignee: Fujisash Company, Kanagawa, Japan

[21] Appl. No.: 29,442

[22] Filed: Mar. 23, 1987

[30] Foreign Application Priority Data

Apr. 1, 1986 [JP] Japan ..... 61-72454

[51] Int. Cl.[4] ..... C25D 11/22

[52] U.S. Cl. ..... 204/37.6; 204/42; 204/58

[58] Field of Search ..... 204/37.6, 42, 58

[56] References Cited

U.S. PATENT DOCUMENTS 3,704,209 11/1972 Patrie ..... 204/37.6
4,042,468 8/1977 Hasegawa et al. ..... 204/42
4,147,598 4/1979 Shigeta et al. ..... 204/37.6
4,316,780 2/1982 Yoshida et al. ..... 204/37.6
4,632,735 12/1986 Santa-Olalla et al. ..... 204/37.6

*Primary Examiner*—John F. Niebling
*Assistant Examiner*—William Leader
*Attorney, Agent, or Firm*—Frishauf, Holtz, Goodman & Woodward

[57] ABSTRACT

A method for electrolytic coloring of anodized aluminum or aluminum alloys in an electrolyte containing metal salts is disclosed, in which the aluminum or aluminum alloy is preliminarily treated in an electrolyte by applying a voltage of substantially positive voltage wave form and, thereafter, the electrolytic coloring is carried out in the same electrolyte by applying an asymmetrical alternating current voltage that the positive voltage is smaller than the negative voltage.

15 Claims, 4 Drawing Sheets

METHOD FOR ELECTROLYTIC COLORING OF ALUMINIM OR ALUMINUM ALLOYS

BACKGROUND OF THE INVENTION

The present invention relates to a method for electrolytic coloring of aluminum or aluminum alloys (hereinafter the term "aluminum" is used to indicate both aluminum and aluminum alloys). More particularly, it is concerned with a method for electrolytic coloring of aluminum which comprises preliminarily treating anodized aluminum by applying a voltage of positive voltage wave form followed by electrolytic coloring by applying a voltage of asymmetrical alternating current, whereby uniform and good coloring can be efficiently applied onto the aluminum surface.

In electrolytic coloring of aluminum, various methods have been proposed to improve the throwing power (or coloring ability) and coloring speed. For example, for improvement of the throwing power in coloring, the following have been proposed: a method in which a newly developed electrolyte is used (Japanese Patent Publication No. 11119/1985), a method in which in electrolytic coloring, the voltage is increased or applied in a newly developed manner (Japanese Patent Publication No. 23663/1979 (corresponding to U.S Pat. No. 4,070,255), Japanese Patent Publication No. 46557/1983, Japanese Patent Application Laid-Open No. 145798/1984, Japanese Patent Publication Nos. 34287/1974, 49408/1977, 27953/1982 and 4503/1978, a method in which prior to electrolytic coloring, specified direct current anodization is applied (Japanese Patent Publication Nos. 13859/1979, 25898/1979 (corresponding to U.S. Pat. No. 4,021,315), 23664/1979, 52037/1983 (corresponding to U.S. Pat. No. 4,316,780), and 39237/1983), and so forth. In addition, to increase the coloring speed in electrolytic coloring, a method of modifying an electrolyte (Japanese Patent Publication Nos. 11119/1985 and 23663/1979), a method of using special material for counter electrode (Japanese Patent Publication No. 13440/1985), and so forth have been proposed.

When practicing these known electrolytic coloring methods and particularly the alternating current electrolytic coloring method, either the throwing power or the coloring speed is improved but the other is improved only insufficiently or rather tends to be reduced.

In particular, the method of coloring by controlling the alternating current with a resistor or thyrister as disclosed in Japanese Patent Publication Nos. 4503/1978, 34287/1974 and 27953/1982 has a problem in that the coloring effect cannot be sufficiently obtained because the barrier layer is not adjusted. The method in which the barrier layer is previously adjusted and then electrolytic coloring is applied using negative direct current with a positive pulse voltage applied, as disclosed in Japanese Patent Publication No. 52037/1983 (corresponding to U.S. Pat. No. 4,316,780) has problems in that controlling the current becomes markedly complicated and equipment cost is increased, both of which are disadvantageous from an economic standpoint.

SUMMARY OF THE INVENTION

The present invention overcomes the above problems and has an object to provide an electrolytic coloring method whereby both the throwing power or coloring ability, and the coloring speed, are increased at the same time.

As a result of extensive investigations, it has been found that the object can be attained by first treating anodized aluminum by applying an anodic voltage wave form followed by the electrolytic coloring accomplished by applying a specified asymmetrical alternating current voltage. The applied voltage may be controlled by electric resistor, by thyristor, or by electric resistor and thyristor.

The present invention is an improvement to the method for electrolytic coloring of anodized aluminum, which improvement comprises preliminarily treating the aluminum by applying a voltage of substantially positive wave form in an electrolyte followed by electrolytic coloring by applying an asymmetrical alternating current voltage, the positive voltage component being smaller than the negative voltage component, usually in the same electrolyte.

DETAILED DESCRIPTION OF THE INVENTION

Figure 1:
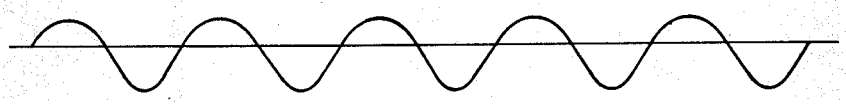
FIGS. 1 to 8 show examples of preferred voltage wave forms for the asymmetrical alternating current to be used in the electrolytic coloring step of the present invention.

The aluminum to be colored according to the present invention is aluminum the surface of which has been anodized. This anodization can be carried out by methods which have heretofore been widely employed. Usually the anodization is carried out by passing a direct current through an acidic electrolyte containing sulfuric acid, oxalic acid, sulfamic acid or the like, using aluminum as an anode. The surface of the aluminum to be anodized is normally cleaned, etched before the aluminum is introduced into the anodizing bath as the anode. Aluminum, graphite, or other "electrolically conductive" material is used as the cathode.

In accordance with the present invention, aluminum which has been anodized is first treated in an electrolyte prior to the electrolytic coloring for modification of the barrier layer.

During modification of the oxidic barrier layer formed by anodization, generally, as the thickness of the modified barrier layer gets larger, the resistance of the barrier layer formed at the time of anodization gets uniform and thus uniform electrolytic coloring can be achieved. If, however, the thickness of the barrier layer is too great, a problem arises in that spalling occurs during electrolytic coloring.

In the method of the present invention, because a special wave form is employed for the voltage used in the electrolytic coloring (after the preliminary treatment) the extent of modification of the barrier layer in the preliminary treatment is not significant. That is, even if the modified barrier layer is relatively thin, the necessary throwing power for electrolytic coloring can be sufficiently obtained. Similarly, even if the thickness of the modified barrier layer is excessively increased, there is no danger of spalling occurring.

For the above reasons, there are no special requirements for the potential to be applied during the preliminary treatment as long as it has a positive voltage wave form. Thus a half-wave rectified current including three phase, a full-wave rectified current including three phase and so forth can be used satisfactorily.

The term "substantially positive voltage wave form" is used herein to include not only a wave form which exhibits a positive voltage all over one cycle but also a wave form which has a small negative voltage portion (for example, the ratio of negative voltage/positive voltage=0 to 0.5). Application of a voltage wave form containing a negative voltage permits increasing the positive voltage to increase the modification effects of the barrier layer.

Further, an asymmetrical alternating current voltage with larger positive voltage than negative voltage can be preferably used. It is convenient that the asymmetrical alternating current voltage is reverse to that of the subsequent coloring treatment. Also there are no special limitations to the current application time, the magnitude of positive voltage to be applied, the voltage increasing speed and so forth. These factors can be determined appropriately depending on conditions. Usual and preferred conditions are exemplified below.

The time for the preliminary treatment depends on treating conditions. Usually the current density for the preliminary treatment is 0.01 to 2 $A/dm^2$ (amperes per square decimeter) and preferably 0.01 to 1 $A/dm^2$ indicated by average positive currents; and usually the time for the preliminary treatment, including the time required for increasing the voltage is 5 to 180 seconds and preferably 10 to 90 seconds. These conditions are conveniently attained in the coloring bath electrolyte.

If, however, the electrolytic coloring treatment is carried out directly without performing the preliminary treatment, the throwing power is not sufficiently satisfactory and either uniform coloring cannot be obtained or coloring can be attained only with difficulty, depending on the type of the electrolyte. Application of a high voltage at the time of coloring to accelerate coloring speed may cause spalling.

The preliminary treatment can be carried out in the electrolyte, the electric conductivity of which is similar to that of an electrolyte used in the subsequent electrolytic coloring treatment.

In accordance with the method of the present invention, after the above preliminary treatment is performed in an electrolyte, the electrolytic coloring treatment is applied, usually in the same electrolyte.

This electrolytic coloring treatment is basically an alternating current electrolytic coloring treatment. In this electrolytic coloring treatment, it is necessary to use an asymmetrical alternating current voltage where the positive voltage is smaller than the negative voltage.

Figure 2:
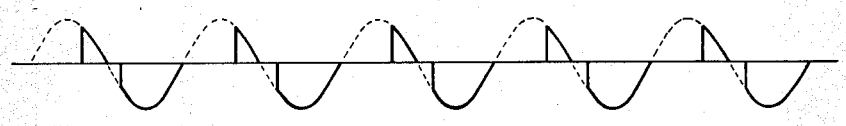
Figure 3:
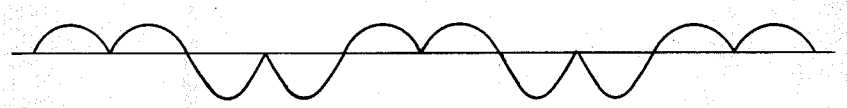
Figure 4:
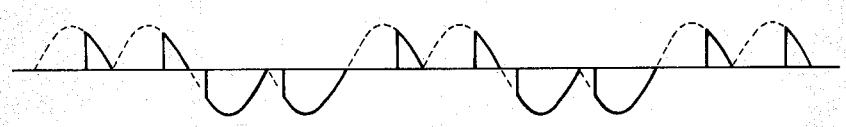
Figure 5:
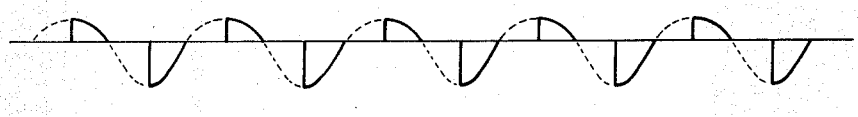
Figure 6:
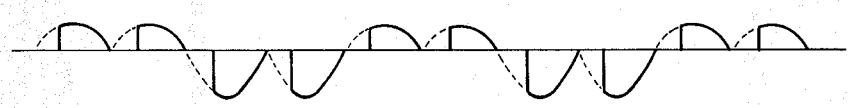
Figure 7:
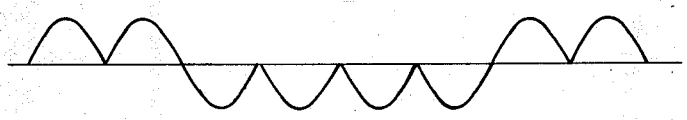
Figure 8:
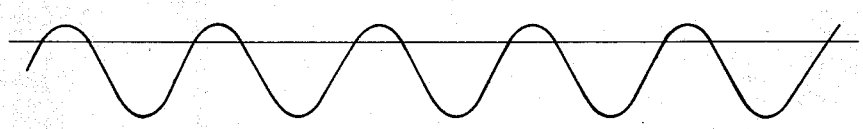

Various types of asymmetrical alternating current voltages can be used in the present invention, including: the usual asymmetrical alternating current wave form as shown in FIG. 1 (in which the times for passing positive and negative voltages are equal but their peak values are different); the asymmetrical alternating current wave form as shown in FIG. 2 in which a sine wave alternating current is controlled at different phase angles for positive and negative waves by the thyrister-control (as a result of which the conduction angle of the negative wave is larger than that of the positive wave); an asymmetrical alternating current wave form as shown in FIG. 3 in which the positive and negative waves of the asymmetrical alternating current shown in FIG. 1 are each doubled; an asymmetrical alternating current wave form as shown in FIG. 4 in which the positive and negative waves of the thyrister-controlled asymmetrical alternating current as shown in FIG. 2 are each doubled; an asymmetrical alternating current wave form as shown in FIG. 5 in which the asymmetrical alternating current wave form shown in FIG. 1 is controlled at the same or different phase angles for the positive and negative waves by the thyrister; an asymmetrical alternating current wave form as shown in FIG. 6 in which the positive and negative waves of the thyrister-controlled asymmetrical alternating current wave form as shown in FIG. 5 are each doubled; and asymmetrical alternating currents in which the positive and negative waves of the asymmetrical alternating current wave forms shown in the above figures are each even numbered like 4, 6, 8 . . . instead of double, can be used. A further example is the asymmetrical alternating current wave form as shown in FIG. 7 in which an even number of multiplied both positive waves and negative waves (the number of the positive waves being smaller than that of the negative waves), is combined. In this case, the numerical ratio of the positive wave to the negative wave is preferably in the range of 2:4 to 2:40 and particularly preferably in the range of 2:6 to 2:20. From a viewpoint of production of an electric source, a wave form in which the wave is multiplied in an even number is preferred. In addition, a direct current superimposed alternating current as shown in FIG. 8 can be used.

In all the asymmetrical alternating current voltages shown in FIGS. 1 to 8, the negative voltage is larger than the positive voltage. In thyrister-controlling therefore, the firing angles of the positive and negative waves should be controlled so that the negative wave is larger than that of the positive wave.

The ratio of the positive voltage to the negative voltage in the asymmetrical alternating current voltage varies with the type of the electrolyte. In general, however, based on an average voltage which is indicated by average value, the ratio of the positive voltage to the negative voltage is 1:1.5 to 1:20 and preferably 1:2 to 1:5. The current for the coloring stage or step of the process is usually from about 0.03 to about 1 $A/dm^2$ and preferably 0.05 to 0.3 $A/dm^2$ indicated by average negative currents. Although coloring time depends on the required color shade and can be determined by inspection, it is usually 10 secs to 30 min and preferably 30 secs to 20 min.

The electrolyte to be used for coloring aluminum according to the present invention contains various metal salts depending on the purpose. Representative examples of the metal salts are the sulfates, nitrates, phosphates, hydrochlorides, oxalates, acetates and tartrates of metals such as nickel, cobalt, copper, salenium, iron, molybdenum and tin.

Conditions for the electrolytic coloring treatment, such as the magnitude of voltage to be applied, the electricity passing time and the liquid temperature can be determined appropriately. Since, however, in accordance with the method of the present invention, the coloring treatment can be carried out at a higher voltage (negative voltage) than in the conventional alternating current electrolytic coloring, the coloring speed can be increased and thus the electrolytic coloring can be carried out in a relatively short time.

In accordance with the present invention, the barrier layer of the anodic coating on the aluminum surface is modified to a certain extent by application of the preliminary treatment and as the electrolytic coloring step, the specified asymmetrical alternating current is used. Thus even if the electrolytic coloring is carried out at a high voltage, the coloring is achieved rapidly and with a high throwing power without causing problems such as spalling, and a uniform and beautiful electrolytic coloring coating can be formed in a short time.

The present invention is described in greater detail with reference to the following examples.

Example 1

An electrolyte containing 90 g/l of nickel sulfate 6 hydrate, 100 g/l of magnesium sulfate 7 hydrate, 40 g/l of boric acid and 3 g/l of tartaric acid and having a pH of 5 was placed in a 500-liter electrolytic coloring vessel. Three A-6063-$T_5$ aluminum extruded profiles, each of which has the cross section shown in FIG. 10 (total length: 500 mm; total depth: 145 mm; total width: 80 mm) were used for coloring. The three test profiles and nickel plates as a counter electrode were placed in the electrolyte. The three test profiles were subjected to the preliminary treatment by increasing a voltage having the wave form shown in FIG. 9 (peak voltage at the maximum, $V_p=80$ v; the ratio of the positive voltage to the negative voltage is 7:1) at a voltage increasing rate of 1V (peack value of the positive voltage)/second and passing electricity at the peak value of 50V for 5 seconds. During this treatment the average volts increased from 0 to 16V (volts) and current density measured as average positive current, went from 0 to 0.3 A/dm$^2$.

Figure 9:
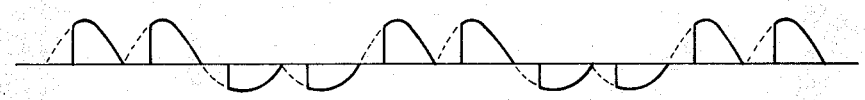
FIG. 9 shows the voltage wave form used in the preliminary treatment of Example 1 and Comparative Example 2.
Figure 10:
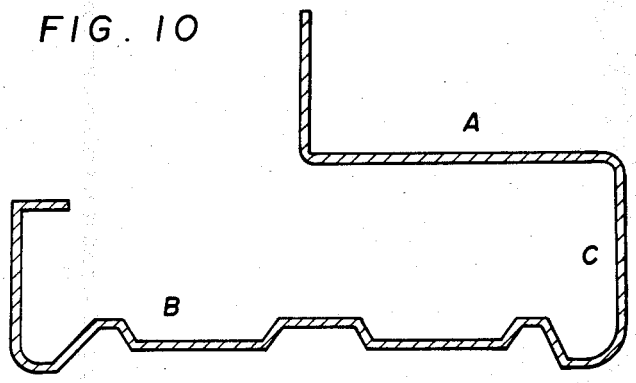
FIG. 10 shows a cross-sectional view of the extruded aluminum profile used in Example 1 and Comparative Examples 1 and 2.

After the preliminary treatment, the electrolytic coloring treatment was carried out by passing electricity for 3.5 minutes at an average positive voltage of 3.5V and an average negative voltage of −10.8V using an asymmetrical alternating current voltage having the wave form shown in FIG. 6 (the positive and negative waves of the voltage wave form shown in FIG. 9 were reversed). During this treatment the current density of 0.18 A/dm$^2$ measured as average negative current. As a result, each of portions A, B and C of the test profile shown in FIG. 10 was finished in a uniform bronze color.

COMPARATIVE EXAMPLE 1

The procedure of Example 1 was repeated with the exception that the preliminary treatment was not applied. The test profiles were not almost colored. When the electricity passing time was prolonged to 10 minutes, the test profiles were slightly colored, but spalling occurred.

COMPARATIVE EXAMPLE 2

The procedure of Example 1 was repeated with the exception that the conventional alternating current was applied in the electrolytic coloring treatment was carried out under conditions of voltage 27V (current density: 0.2 A/dm$^2$) and treating time 3.5 minutes. In the test profile shown in FIG. 10, the portion A was in a bronze color and the portions B and C, in a gold color, and the coloring was not uniform.

Example 2

Figure 11:
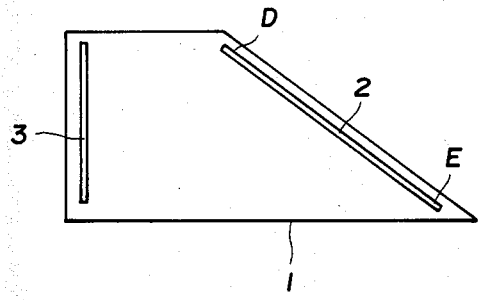
FIG. 11 shows a plan view illustrating the arrangement of the apparatus used in Example 2 and Comparative Example 3, and the test plate placed therein.

An electrolyte containing 80 g/l of cobalt sulfate 6 hydrate, 80 g/l of magnesium sulfate, 30 g/l of boric acid and 2 g/l of citric acid and having a pH of 4.3 was placed in a Hul cell test apparatus as shown in FIG. 11 (a plan view with an upper bottom of 80 mm, a lower bottom of 250 mm and a length of 80 mm; the angle is made sharper than that of the normal Hull cell test apparatus for plating). An anodized test plate (A-1100-H14 aluminum: 100 mm (length)×180 mm (width)×1.5 mm (thickness)) as an anode and a carbon rod as a cathode were placed in the electrolyte, and the preliminary treatment was applied by passing a direct current of 30V (current density: 0.2 A/dm$^2$) for 10 seconds.

After the preliminary treatment, the electrolytic coloring treatment was carried out using an asymmetrical alternating current voltage having the wave form shown in FIG. 2 (negative peak voltage at the maximum, Vp=50V; conduction angle of the positive voltage: 60°) under conditions of average positive voltage 3.1V, average negative voltage −8V (current density as average negative current: 0.2 A/dm$^2$) and treating time 3 minutes. Both the portions D and E were in a darker bronze color, and the whole was finished uniformly.

COMPARATIVE EXAMPLE 3

The procedure of Example 2 was repeated with the exception that the conventional alternating current (voltage: 18V; current density: 0.25 A/dm$^2$) was applied in the electrolytic coloring treatment. The portion D of the test plate (a portion near the counter electrode) was in a darker bronze color and the portion E (a portion far from the counter electrode), in a lighter bronze color. This shows that the test plate was colored unevenly.

The above is illustrative but not limitive of the invention as various modifications can be made within the scope and spirit of the invention, which would be obvious to the skilled artisan.

What is claimed is:

1. In a method for electrolytic coloring of an anodized aluminum or aluminum alloy workpiece, the improvement comprising preliminarily treating the aluminum or aluminum alloy workpiece in an electrolyte by applying a voltage of substantially positive voltage wave form in the form of a first asymmetrical alternating current voltage in which the positive voltage is larger than the negative voltage and, thereafter, electrolytically coloring the aluminum or aluminum alloy workpiece in an electrolyte containing metal salts, by applying a second asymmetrical alternating current voltage having positive and negative waves and in which the positive voltage is smaller than the negative voltage and both the positive and negative waves are doubled.

2. The method of claim 1 wherein the first asymmetrical alternating current voltage is reverse to that of the coloring treatment.

3. The method of claim 1 wherein the second asymmetrical alternating current voltage is controlled by electric resistor.

4. The method of claim 1 wherein the second asymmetrical alternating current voltage is controlled by thyrister.

5. The method of claim 1 wherein the second asymmetrical alternating current voltage is controlled by electric resistor and thyrister.

6. The method of claim 1 wherein the ratio of positive to negative voltage for the second asymmetrical alternating current is 1:1.5 to 1:20.

7. The method of claim 6 wherein the ratio of positive to negative voltage for the second asymmetrical alternating current is 1:2 to 1:5.

8. The method of claim 1 wherein the electrolyte of the preliminary treatment is the same as the electrolyte of the coloring treatment.

9. The method of claim 1 wherein the first asymmetrical alternating current voltage is controlled by electric resistor.

10. The method of claim 9 wherein positive and negative waves of the asymmetrical alternating current voltage are each doubled.

11. The method of claim 1 wherein the first asymmetrical alternating current voltage is controlled by thyrister.

12. The method of claim 11 wherein positive and negative waves of the first asymmetrical alternating current voltage are each doubled.

13. The method of claim 1 wherein the first asymmetrical alternating current voltage is controlled by electric resistor and thyrister.

14. The method of claim 13 wherein positive and negative waves of the first asymmetrical alternating current voltage are each doubled.

15. The method of claim 1 wherein the first asymmetrical alternating current voltage is direct current superimpose alternating current.

* * * * *